United States Patent [19]

Bouzianis et al.

[11] Patent Number: 4,521,176

[45] Date of Patent: Jun. 4, 1985

[54] SHOE UPPER CAVITY SHELL

[75] Inventors: George J. Bouzianis, Ipswich; Donald B. McIlvin, Danvers, both of Mass.

[73] Assignee: USM Corporation, Farmington, Conn.

[21] Appl. No.: 656,076

[22] Filed: Sep. 28, 1984

[51] Int. Cl.[3] ..... B29F 1/00; B29D 27/00

[52] U.S. Cl. ..... 425/521; 425/119; 425/129 S; 12/54.3

[58] Field of Search ..... 425/119, 129 S, 521, 425/520

[56] References Cited

U.S. PATENT DOCUMENTS

| | | | |
|---|---|---|---|
| 2,600,507 | 6/1952 | Leahy et al. | 425/119 X |
| 3,173,173 | 3/1965 | Lister | 425/119 |
| 3,189,946 | 6/1965 | Ciaio | 425/129 S |
| 3,200,438 | 8/1965 | McIlvin | 425/119 |
| 3,299,476 | 1/1967 | McIlvin | 425/129 S X |
| 3,350,748 | 11/1967 | McIlvin | 425/119 X |
| 3,380,123 | 4/1968 | Schmidt | 425/119 |
| 3,412,433 | 11/1968 | Ralphs et al. | 425/119 X |
| 3,541,646 | 11/1970 | Baudou | 425/119 |
| 4,344,199 | 8/1982 | Bouzianis et al. | 425/521 X |
| 4,380,524 | 4/1983 | Runions | 425/129 S X |

*Primary Examiner*—J. Howard Flint, Jr.

*Attorney, Agent, or Firm*—Donald N. Halgren

[57] ABSTRACT

A V-shaped shell comprising a replaceable tip for a mold apparatus utilizable for squeezing a shoe upper against a female mold. The V-shaped shell comprises generally planar members meeting at a curvilinear apex, each planar member having a raised periphery which tapers inwardly towards the surface of the planar member, to define a pre-arranged volume for the tapered distribution of stiffening resin applied between the inner liner and outer layer of a shoe upper.

9 Claims, 1 Drawing Figure

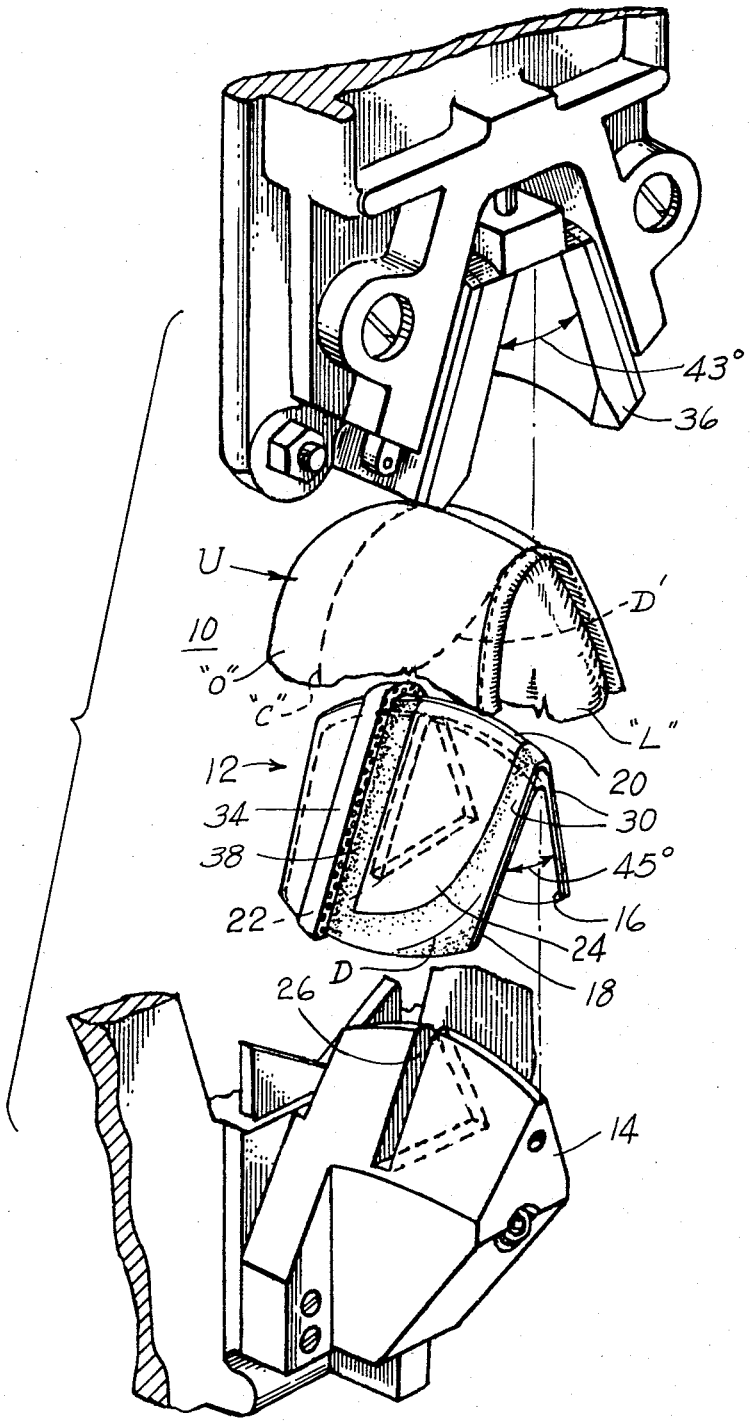
43°
36
U
10
"O"
"C"
D'
"L"
12
20
34
30
38
45°
22
16
24
D
18
26
14

SHOE UPPER CAVITY SHELL

BACKGROUND OF THE INVENTION (1) Field of the Invention

This invention relates to shoe machinery and more particularly to a device for properly defining the shape of a shoe upper during a stiffening operation.

(2) Prior Art

Stiffening of portions of shoe uppers by coating the portion to be stiffened with a layer of molten resin and solidifying the resin was disclosed in the U.S. Pat. No. 3,316,573 to Chaplick et al. In the process of that patent, molten thermoplastic polymeric material was spread as a layer on a shoe upper at a temperature at which the thermoplastic material has a viscosity low enough to wet and adhere to the surface of the article to be stiffened but sufficiently high so that it will substantially not penetrate the shoe component, and the layer of material so formed was cooled and shaped to form a stiff, resilient layer holding the article in the desired configuration.

The process referred to has entered into substantial commercial use for the stiffening of toe portions of shoes, but heel portions of shoes because of the relatively small radius curves and the seam, have not lent themselves to deposition of a useful thermoplastic material stiffening layer by procedures shown in the patent.

Stiffening of portions of shoes by disposing them between mating mold halves and injecting molten stiffener material between the shoe upper layers in the mold has been proposed. However, this method has severe economic and operational difficulties which have prevented its acceptance. That is, the special two-part mold is costly particularly since different molds would be required for every distinct style of heel end and in some cases different molds would be required for different sizes of the same style. Further disadvantages are that since molten resin is introduced between two layers of shoe material, dissipation of heat to allow stiffening of the resin is retarded by the heat insulating action of the shoe upper materials so that the "in mold" time is long. Also, the thickness of the resin layer formed is dependent on the space left in the mold between the layer of upper material and the liner and hence varies inversely as the thicknesses of the upper material and liner, which in the case of leather are known to be highly variable even between the two sides of a shoe.

A further procedure for stiffening portions of shoes involves the disposition of a thermosetting material on a stiffener blank or on a portion of the upper by means of a special distributor head. This distributor head squeezes out a pattern of a pasty material from a series of extruder orificii in a plate pressed against the blank or shoe upper and this pattern is spread as a uniform layer by applying pressure to flow the material over the selected area of the shoe component. Because of "stringing" and other problems, this procedure is not suitable for application of molten resinous stiffeners.

Further advances in stiffening of shoe uppers is shown in U.S. Pat. No. 4,344,199 to Bouzianis et al where a reciprocable and rotatable nozzle is disposed on an extruder. A male mold is bolted to a support which in turn is attached to a carrier. Any need to change size or style of a shoe upper being stiffened required unbolting and disassembly of a heavy mold structure from its support. A similar type of mold is shown in U.S. Pat. No. 4,127,910 to Hollick wherein a solid male plug is bolted to a support, and a rubber strip is adhered to the outside; the inner perimeter of which defined a pocket into which the stiffening material would press the inner liner of the shoe upper, after the nozzle had ejected the hot resinous material between the inner liner and the outer layer of the shoe upper prior to its being molded between the male and female mold members, in an attempt to distribute the stiffening resin properly therein.

It is an object of the present invention to provide easily interchangeable, lightweight mold members which can be quickly utilized to minimize machine down-time between shoe size or style changes in a shoe upper stiffening machine.

It is a further object of this invention to provide a mold member capable of providing the proper taper in a stiffening element disposed in the heel pocket of a shoe upper.

BRIEF SUMMARY OF THE INVENTION

A mold apparatus adaptable for use in a shoe upper stiffening machine where a multi-orifice nozzle rotates into and pivots in between the inner and outer layers of the heel pocket of a shoe upper to discharge a resinous material therein. The mold apparatus is disposed on the distal end of an upwardly extending mold support member to come together with a female mold to press the resin filled heel portion of a shoe upper together. The mold apparatus comprises a generally V-shaped shell formed from two generally planar surfaces which meet in a slightly curvilinear juncture which forms the apex or top portion of the male mold apparatus.

A triangularly-shaped plate is secured transversely between the inside surfaces of the planar members of the mold. The triangular plate acts as a reinforcement brace for the side portions of the mold and as a locating means which is received in a slot disposed across the upper end of the mold support member. The peripheral portions of each outer generally planar member are raised slightly therefrom at its edges and gradually taper inwardly toward the surface of its planar members. A foam or neoprene type rubber strip is glued to the side of each planar member which strip defines the lowest portion of a shoe upper on which the ejected resinous material should go.

The male mold member is constructed at a 45° angle to meet a yieldable female mold member which is constructed at an angle of 43°. The raised peripheral portions which are taperingly disposed away from the surface of the planar members are what presses the heel of the upper into contact with the female mold member, so as to make a line of contact therebetween. The rubber strip provides a line of contact which acts against the liner and outer layer of the shoe upper and the female mold member. There is a slight tapered portion which leads to the rubber strip.

When the resinous material is ejected onto the inner side of the outer layer of the upper, the inner layer of the upper is brushed thereagainst by a wiping element, as shown in commonly assigned co-pending U.S. patent application Ser. No. 656,136, filed Sept. 28, 1984, and incorporated herein by reference. The male mold is caused to move upwardly once the inner liner has been wiped over the resin, which resin is thus caused to be distributed in the heel pocket created by the liner made at the outer periphery of the tapered portion of the male/female molds and the rubber strip, which gives the length to the stiffening (counter) material, the tapers providing the diminishing flexibility from the perimeter thereof.

BRIEF DESCRIPTION OF THE DRAWINGS

The objects and advantages of the present invention will become more apparent when viewed in conjunction with the following drawing, in which:

the FIGURE is an exploded perspective view of a portion of the female mold, the upper, the male mold and the male support head of a shoe upper stiffening machine.

DESCRIPTION OF THE PREFERRED EMBODIMENTS

Referring now to the drawing in detail, there is shown a mold apparatus 10 utilizable in a shoe upper stiffening machine as shown in U.S. Pat. No. 4,344,199 or in U.S. patent application Ser. No. 656,136, filed Sept. 28, 1984, each herein incorporated by reference, wherein a multi-orifice nozzle is caused to rotate into and pivot between a pair of layers (the inner liner and the outer layer) of a shoe upper to discharge a resinous quantity of stiffening material on the inside of the heel portion of the outer layer.

The mold apparatus 10 comprises a generally V-shaped shell 12 and is disposable on the distal end of an upwardly extending mold support member 14, as shown in the FIGURE. The mold shell 12 may be described as a "skim-coating" of the mold support 14, and is actually comprised of a pair of generally planar surfaces 16 and 18, as shown in the FIGURE, which meet in a slightly curvilinear juncture 20 which forms the apex or uppermost portion of the male mold shell 12.

A triangularly-shaped plate 22 is secured transversely between the insides of the planar surfaces 16 and 18, as shown in dashed lines in the FIGURE. The triangular plate 22 acts as a reinforcing brace for the side surfaces 16 and 18 of the mold shell 12, and it also acts as a locating means which is received in a slot 26 which is correspondingly disposed across the upper end of the male support member 14. The planar members 16 and 18 have peripheral portions 30, which are raised slightly therefrom at their edges and gradually taper inwardly toward the surface 24 of their planar members 16 and 18, as shown in the FIGURE. A rubber strip 34 which may be of foamed or neoprene type is glued to the side of each planar member 16 and 18, which strip 34 defines the lowest portion in the heel pocket of a shoe upper being stiffened in which the resinous material is ejected, should go. That is, the rubber strip 34 touches the liner first and comresses itself until the rest of the shell 12 is in mating contact with the upper U. This first contact permits the resin to spread itself within the pocket between the liner "L" and the outer layer "O", but no closer to the feather edge of the upper U than that permitted by the strip 34.

The male mold member 12 is constructed so that the planar members 16 and 18 meet at an angle of about 45°. A yieldable female mold member 36 into which a shoe upper U having a heel pocket into which resin is ejected, is formed with leg portions which meet at an angle of about 43°. The peripheral portions 30, which are taperingly disposed outwardly, away from the surface of the planar members 16 and 18, are what presses the heel portion of a shoe upper assembly U into contact with the female mold assembly, so as to make a curvilinear line of contact "D" therebetween. The rubber strip 34 provides the "first" line of contact "C" which also pinches the liner "L" and the outer layer "O" of the shoe upper U between itself and the female mold member. A slight tapered portion 38 extends from the surface of the planar members 16 and 18 outwardly therefrom as it approaches the rubber strip 34.

After the resinous stiffening material is ejected into the heel pocket of a shoe upper by the nozzles sweeping past the inside of the outer layer "O" as decribed in the aforementioned commonly assigned patent application, the inner layer "L" of the shoe upper is brushed against the resinous stiffening material by a wiping element, which nozzle and wiping element are thereupon withdrawn from the shoe upper. The male shell apparatus 12 is then caused to move upwardly by proper means, once the inner liner "L" of a shoe upper "U" has been wiped over the resin, which resin is thereupon caused to be distributed in the pocket (between the inner liner and the outer layer of the shoe upper) created by the high "ridge" D made along the outer periphery 30 of the tapered portion of the male shell 12 and the rubber strip 34 and the inside of the female mold 36, which strip 34 determines the length to the stiffening (counter) material, the tapers providing the diminishing flexibility to the stiffening material, to their perimeters thereof.

The overall size of the shell 12 can be varied for different size shoe uppers being operated upon. The length of the curvilinear juncture 20 corresponds to the length of the seam of the shoe upper at its heel. The size of the planar members 16 and 18 and the corresponding dimensions of their tapered portions 30 or the length of the rubber strip 34 may be made to accommodate any size shoe upper. Thus, all a machine operator would have to do to change from one shoe size (or style) being stiffened to another, would be to lift off the shell 12 from its location to the male support member 14 and its locating slot 26 and insert another appropriate shell 12 thereon, with its respective triangular plate 22 fitting into the slot 26.

Thus there has been described a novel apparatus for distributing resinous stiffening material ejected into a heel portion of a shoe upper, by the use of interchangeable shell which causes by pressure against a mating female mold, the tapered juxtaposition of the resinous material within that pocket prior to being cooled and set in that tapered pre-planned configuration.

We claim:

1. In a mold apparatus for a shoe resin applying machine in which a shoe upper has a resin ejected into a heel pocket between an inner layer and an outer layer of that upper having a male mold apparatus which is caused to press the treated upper into a female mold, wherein the improvement comprises:

a shell mold matable over the distal portion of said male mold apparatus and arranged to correspond to the configuration of the shoe upper being worked upon.

2. A mold apparatus, as recited in claim 1, wherein said shell mold is of a V-shaped configuration and comprised of two generally planar members.

3. A mold apparatus as recited in claim 2, wherein said V-shaped shell mold has a triangular plate securely spaced between said planar members to strengthen them and provide locating means for said shell mold onto said mold apparatus.

4. A mold apparatus as recited in claim 2, wherein said planar members have a raised peripheral portion which tapers slightly inwardly to the surface of the planar members.

5. A mold apparatus as recited in claim 4, wherein a rubber strip is disposed down one edge of each planar member to provide a barrier for distribution of resin in a shoe upper being operated upon.

6. A mold apparatus as recited in claim 5, wherein a tapered segment is disposed on said planar member adjacent said rubber strip.

7. A mold apparatus as recited in claim 5, wherein said planar members define an angle of about 45°.

8. A mold apparatus as recited in claim 7, wherein the angle defined by said planar member is greater than any angle defined by its corresponding female mold.

9. A mold apparatus as recited in claim 7, wherein the juncture of said two planar members is slightly curvilinear.

* * * * *